US011097562B2

(12) United States Patent
Saito et al.

(10) Patent No.: US 11,097,562 B2
(45) Date of Patent: Aug. 24, 2021

(54) PRINTING APPARATUS

(71) Applicant: SEIKO EPSON CORPORATION, Tokyo (JP)

(72) Inventors: Yusuke Saito, Yamagata-mura (JP); Kenichiro Kaneko, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/661,592

(22) Filed: Oct. 23, 2019

(65) Prior Publication Data

US 2020/0130388 A1 Apr. 30, 2020

(30) Foreign Application Priority Data

Oct. 24, 2018 (JP) ..... JP2018-199765

(51) Int. Cl.

| | |
|---|---|
| ***B41J 25/00*** | (2006.01) |
| ***B41J 29/377*** | (2006.01) |
| ***B41J 2/14*** | (2006.01) |
| ***B41J 2/01*** | (2006.01) |
| ***B41J 29/02*** | (2006.01) |
| ***B41J 29/393*** | (2006.01) |

(52) U.S. Cl.

CPC ..... *B41J 25/006* (2013.01); *B41J 2/01* (2013.01); *B41J 2/14* (2013.01); *B41J 29/02* (2013.01); *B41J 29/377* (2013.01); *B41J 29/393* (2013.01)

(58) Field of Classification Search

CPC ..... B41J 2/01; B41J 2/14; B41J 25/006; B41J 29/02; B41J 29/377; B41J 29/393

See application file for complete search history.

(56) References Cited

U.S. PATENT DOCUMENTS

| | | | | |
|---|---|---|---|---|
| 5,406,316 | A * | 4/1995 | Schwiebert | B41J 11/002 346/25 |
| 5,831,655 | A * | 11/1998 | Asawa | B41J 29/377 347/102 |
| 6,203,152 | B1 * | 3/2001 | Boleda | B41J 29/377 347/102 |
| 2008/0079795 | A1 * | 4/2008 | Nakazawa | B41J 11/002 347/102 |
| 2015/0321493 | A1 | 11/2015 | Yoshizawa | |
| 2019/0232648 | A1 | 8/2019 | Hiramatsu | |

FOREIGN PATENT DOCUMENTS

| | | |
|---|---|---|
| JP | 2003-220696 | 8/2003 |
| JP | 2014-144588 | 8/2014 |
| WO | 2017/221628 | 12/2017 |

* cited by examiner

*Primary Examiner* — Anh T Vo

(74) *Attorney, Agent, or Firm* — Workman Nydegger

(57) ABSTRACT

A printing apparatus includes a discharge head configured to discharge a liquid toward a medium, a head control board configured to control the discharge head, a circuit case having a box-like shape configured to house the head control board, and a carriage configured to reciprocate in a scanning direction while supporting the discharge head and the circuit case. The circuit case includes an air intake port in one surface of the circuit case, with the one surface intersecting with the scanning direction, and an exhaust port in another surface of the circuit case, with the other surface intersecting with the scanning direction. At the exhaust port, an exhaust fan configured to exhaust, to outside of the circuit case, heat that is inside the circuit case is installed, the heat being generated by the head control board.

6 Claims, 5 Drawing Sheets

PRINTING APPARATUS

The present application is based on, and claims priority from JP Application Serial Number 2018-199765, filed Oct. 24, 2018, the disclosure of which is hereby incorporated by reference herein in its entirety.

BACKGROUND

1. Technical Field

The present disclosure relates to a printing apparatus that performs printing on a medium.

2. Related Art

A printing apparatus is known that performs printing on a medium such as roll paper. The printing apparatus typically includes a discharge head discharging ink, and a carriage holding the discharge head and reciprocating in a scanning direction. The printing apparatus performs printing by discharging ink from the discharge head toward the medium while moving the carriage in the scanning direction. Note that, in such a printing apparatus, a circuit board installed inside the carriage and driving the discharge head generates heat and that the heated circuit board needs to be cooled.

WO 2017/221628 discloses a liquid discharging device (printing apparatus) including a carriage supporting a discharge head, a head driving circuit, and a heat dissipation unit configured to dissipate heat generated by the head driving circuit, and also including an air blowing unit provided in a region outside a movement region for the carriage. The air blowing unit generates an airflow toward the heat dissipation unit to cool the head driving circuit.

In the liquid discharging device disclosed in WO 2017/221628, the air blowing unit is installed above the carriage, and air from the air blowing unit is caused to flow downward in order to cool the heat dissipation unit supported by the carriage. Then, the air, the temperature of which has increased due to heat drawn from the heat dissipation unit, flows further downward. However, since the discharge head is installed below the heat dissipation unit, the air with the increased temperature flows around nozzles in the discharge head. When such air flow continues for a long period of time, the heat is likely to cause failure in discharge such as drying of the liquid (ink) around the nozzles.

Accordingly, an object is to cool the heated circuit board and to suppress the adverse effect, on the discharge head and the like, of the air, the temperature of which has increased due to the heat drawn from the circuit board.

SUMMARY

A printing apparatus according to the present disclosure includes a discharge head configured to discharge a liquid toward a medium, a head control board configured to control the discharge head, a circuit case having a box-like shape configured to house the head control board, and a carriage configured to reciprocate in a scanning direction while supporting the discharge head and the circuit case. The circuit case includes an air intake port in one surface thereof, with the one surface intersecting with the scanning direction, and includes an exhaust port in another surface thereof, with the other surface intersecting with the scanning direction. At the exhaust port, an exhaust fan configured to exhaust, to outside of the circuit case, heat that is inside the circuit case is installed, the heat being generated by the head control board.

The printing apparatus described above may include a carriage shaft configured to move the carriage and a frame configured to support the carriage shaft. The circuit case may be positioned at an upper side of the frame in a vertical direction, and the discharge head is positioned at a lower side of the circuit case.

The printing apparatus described above may include a maintenance region where maintenance of the discharge head is performed. The exhaust fan may rotate when the carriage is positioned in the maintenance region.

The printing apparatus described above may include a platen configured to guide transport of the medium. The exhaust fan may exhaust air toward the platen side.

The printing apparatus described above may include a supply tube configured to supply the liquid to the discharge head, and the supply tube may be installed by being drawn into the carriage from the air intake port side.

In the printing apparatus described above, the circuit case may include therein a plurality of head driving boards, provided separately from the head control board, and the plurality of head driving boards may have component surfaces intersecting with the scanning direction, with the component surfaces of the head driving boards being installed away from one another and side by side in the scanning direction, and the component surfaces and the exhaust fan may be installed staggered from each other when viewed from the scanning direction.

DESCRIPTION OF EXEMPLARY EMBODIMENTS

Embodiments of the present disclosure will be described below with reference to the accompanying drawings. Note that, in each of the figures below, each of members is drawn to a scale different from an actual scale so as to have a recognizable size.

Figure 1:
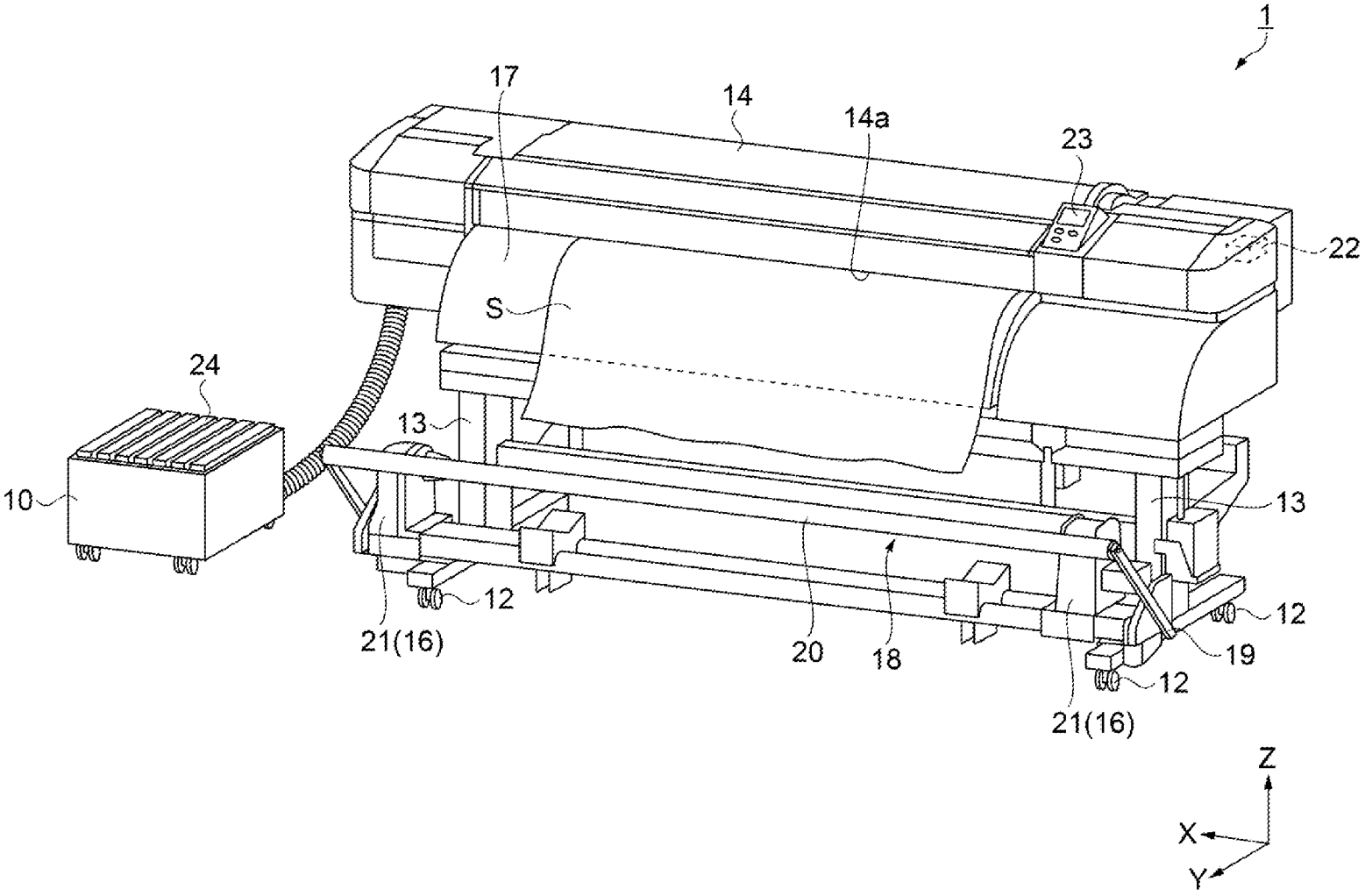
FIG. 1 is a perspective view illustrating a printing apparatus according to the present embodiment.
Figure 2:
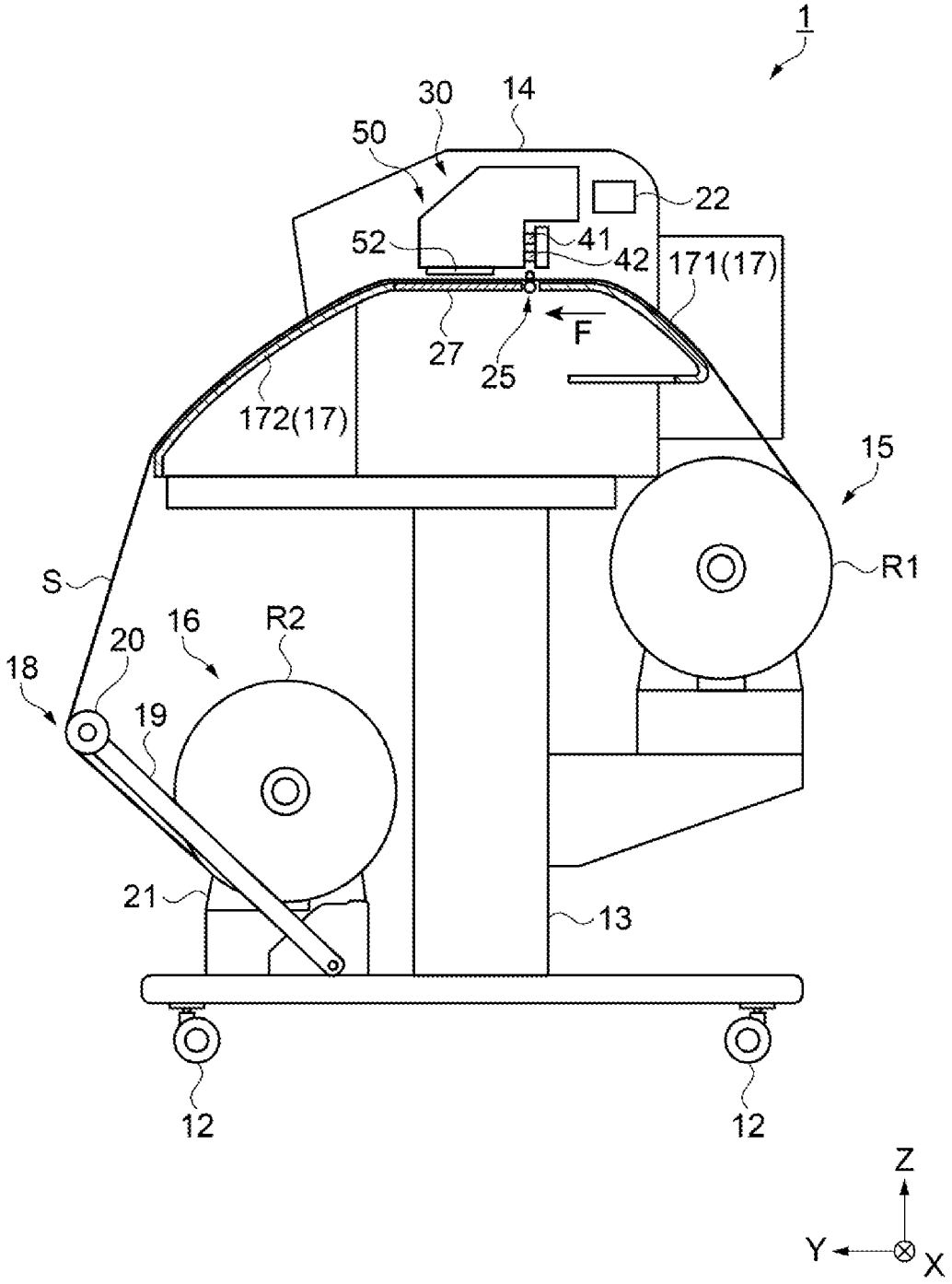
FIG. 2 is a cross-sectional view illustrating a general configuration of the printing apparatus.

FIG. 1 is a perspective view of a printing apparatus 1 according to the present invention. FIG. 2 is a cross-sectional view illustrating a general configuration of the printing apparatus 1.

As illustrated in FIG. 1, the printing apparatus 1 according to the present embodiment is a large format printer (LFP) configured to handle an elongated sheet S. The printing apparatus 1 includes a pair of leg portions 13 with wheels 12 attached to a lower end of each leg portion, and a housing portion 14 assembled on upper portions of the leg portions 13.

Note that each of the following drawings, including FIG. 1, is illustrated using a XYZ coordinate system. A Z direction is a direction along the gravitational direction and the vertical direction. Hereinafter, the Z direction is referred to as the up and down direction Z or the height direction Z. An X direction intersects with the up and down direction Z (the X direction is orthogonal to the up and down direction in the present embodiment), and is a longitudinal direction of the housing portion 14. Hereinafter, the X direction is referred to as the width direction X or the scanning direction X. Furthermore, a Y direction is a direction intersecting both with the up and down direction Z and with the width direction X (the Y direction is orthogonal to the up and down direction Z and the width direction X in the present embodiment). Hereinafter, the Y direction is referred to as the front and back direction Y.

In the front and back direction Y, an apparatus front side of the printing apparatus 1 is represented as a +Y direction, and an apparatus back side or an apparatus rear side is represented as a −Y direction. When the printing apparatus 1 is viewed from the front side, an apparatus left side in the width direction X is represented as a +X direction, and an apparatus right side in the width direction is a −X direction. In the up and down direction Z, an apparatus upper side, an apparatus upper direction, an apparatus upper portion, an apparatus upper surface, and the like are represented as a +Z direction, and an apparatus lower side, an apparatus lower direction, an apparatus lower portion, an apparatus lower surface, and the like are represented as a −Z direction.

A feeding unit 15 (see FIG. 2) configured to feed the sheet S toward the housing portion 14 side is installed below the housing portion 14 on the apparatus back side. The sheet S according to the present embodiment is roll paper. The sheet S is a transfer medium such as transfer paper used to transfer a transfer image to a transfer target medium such as a polyester fiber for sublimation transfer printing; the transfer image serves as a mirror image formed so as to leave white spaces at end portions in the width direction X, corresponding to a lateral direction. The printing apparatus 1 according to the present embodiment is an ink jet-type printer configured to form a transfer image by ejecting a sublimation-type printing ink onto the sheet S, the sublimation-type printing ink being an example of a liquid. Hereinafter, the sublimation-type printing ink is simply referred to as ink.

As illustrated in FIG. 2, winding units 16 supported by the leg portions 13 are installed below the housing portion 14 on the apparatus front side. A medium guiding unit 17 is installed along a transport path for the sheet S between the feeding unit 15 and the winding units 16. The medium guiding unit 17 includes a feeding guiding unit 171 installed on the feeding unit 15 side, and a winding guiding unit 172 installed on the winding unit 16 side. Note that a platen 27 is installed so as to couple the feeding guiding unit 171 and the winding guiding unit 172 together.

In the medium guiding unit 17, a back end side of the feeding guiding unit 171 is bent and housed within the housing portion 14, and a front end side of the winding guiding unit 172 protrudes forward from the housing portion 14. A discharge port 14*a* through which the sheet S is discharged from inside the housing portion 14 is formed on the front side of the housing portion 14 at a position above the medium guiding unit 17.

A tension applying mechanism 18 is installed in the vicinity of each of the winding units 16; the tension applying mechanism 18 is positioned between the winding guiding unit 172 and the winding unit 16 and applying tension to the sheet S. The tension applying mechanism 18 includes a pair of arm members 19 rotatably supported near lower portions of the leg portions 13, and a tension roller 20 rotatably supported by tip portions of the pair of arm members 19. The winding units 16 include a pair of holders 21 configured to interpose the core material (not illustrated, e.g. a paper tube) from both sides in an axial direction, the core material winding the printed sheet S in a cylindrical shape1.

A control unit 22 configured to integrally control operations of the printing apparatus 1 is installed inside the housing portion 14. An operation panel 23 on which setting operations and input operations are performed is installed on an upper portion of the housing portion 14 and on the right side of the housing portion 14 in the width direction X. Note that the operation panel 23 is electrically coupled to the control unit 22.

A container box 10 configured to house liquid reservoirs 24 is installed below the housing portion 14 on an apparatus left side and separately from the housing portion 14 and the leg portions 13. The container box 10 houses a plurality of liquid reservoirs 24 corresponding to the types and colors of inks used in the printing apparatus 1. Note that, in the present embodiment, seven liquid reservoirs 24 are contained.

As illustrated in FIG. 2, the feeding unit 15 holds a roll body R1 in which an unprinted sheet S is rolled in a cylindrical shape. Note that the feeding unit 15 is replaceably loaded with roll bodies R1 that have a plurality of sizes, which are different from one another in length in the width direction X corresponding to the width of the sheet S and/or in the number of turns.

Note that each of the roll bodies R1 is loaded in the feeding unit 15, for example, closer to a predetermined right end portion of the feeding unit 15 in the width direction X regardless of the size of the roll body R1. In other words, in the present embodiment, the predetermined right end portion in the width direction X is set as a reference position for alignment of the sheet S. When the feeding unit 15 rotates the roll body R1 counterclockwise in FIG. 2, the sheet S is unrolled from the roll body R1 and fed into the housing portion 14.

The housing portion 14 internally houses a transport roller 25 configured to transport the sheet S, a printing unit 30 configured to print the sheet S transported in a transport direction F by the transport roller 25, the platen 27 configured to support the sheet S, and a suction mechanism (not illustrated) configured to suction the sheet S. The suction mechanism sucks the sheet S transported above an upper surface of the platen 27 to suck the sheet S against the upper surface of the platen 27.

The printing unit 30 includes two carriage shafts 41 and 42 installed to extend in the width direction X, a carriage 50 supported by the carriage shaft 41 and 42, and discharge heads 52 held at a lower portion of the carriage 50. The discharge heads 52 perform printing by discharging the inks toward the sheet S being transported.

Note that the configuration of the printing unit 30 will be described in detail below.

The carriage 50 reciprocates in the scanning direction X orthogonal to the transport direction F of the sheet S along the carriage shafts 41 and 42. Note that when discharging the inks toward the sheet S, the discharge heads 52 lie opposite to the platen 27.

A reflective sensor (not illustrated) serving as a paper width sensor is held on the lower portion of the carriage 50 at a position downstream of the discharge heads 52 in the transport direction F. When the carriage 50 moves in the scanning direction X, the reflective sensor senses the positions of both end portions of the sheet S in the width direction X, and calculates a length of the sheet S in the width direction X.

Note that after printing is finished, the sheet S is guided diagonally downward along the winding guiding unit 172 leading to the downstream side of the platen 27, the sheet S is wound by the winding units 16 to form a roll body R2. At this time, the tension roller 20 presses a back surface side of the sheet S depending from the winding guiding unit 172 under the weight of the sheet S, to apply tension to the sheet S being wound around the winding units 16.

In the printing apparatus 1 according to the present embodiment, the sheet S can be discharged without being wound into the roll body R2. For example, the printed sheet S can be housed in a discharge basket (not illustrated) attached instead of the winding units 16.

Figure 3:
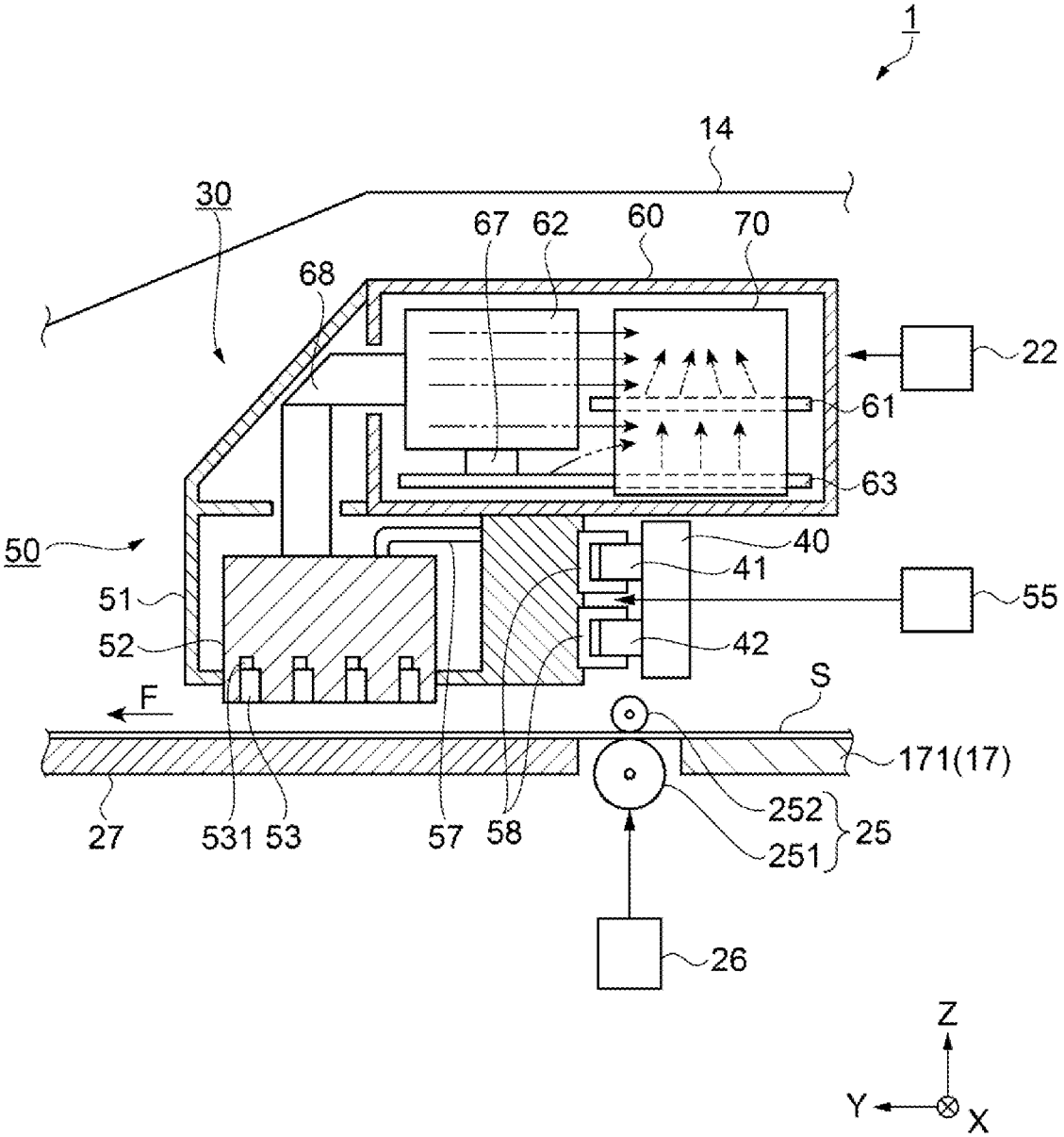
FIG. 3 is a schematic cross-sectional view of a peripheral configuration including a printing unit of the printing apparatus when viewed from an apparatus right side.
Figure 4:
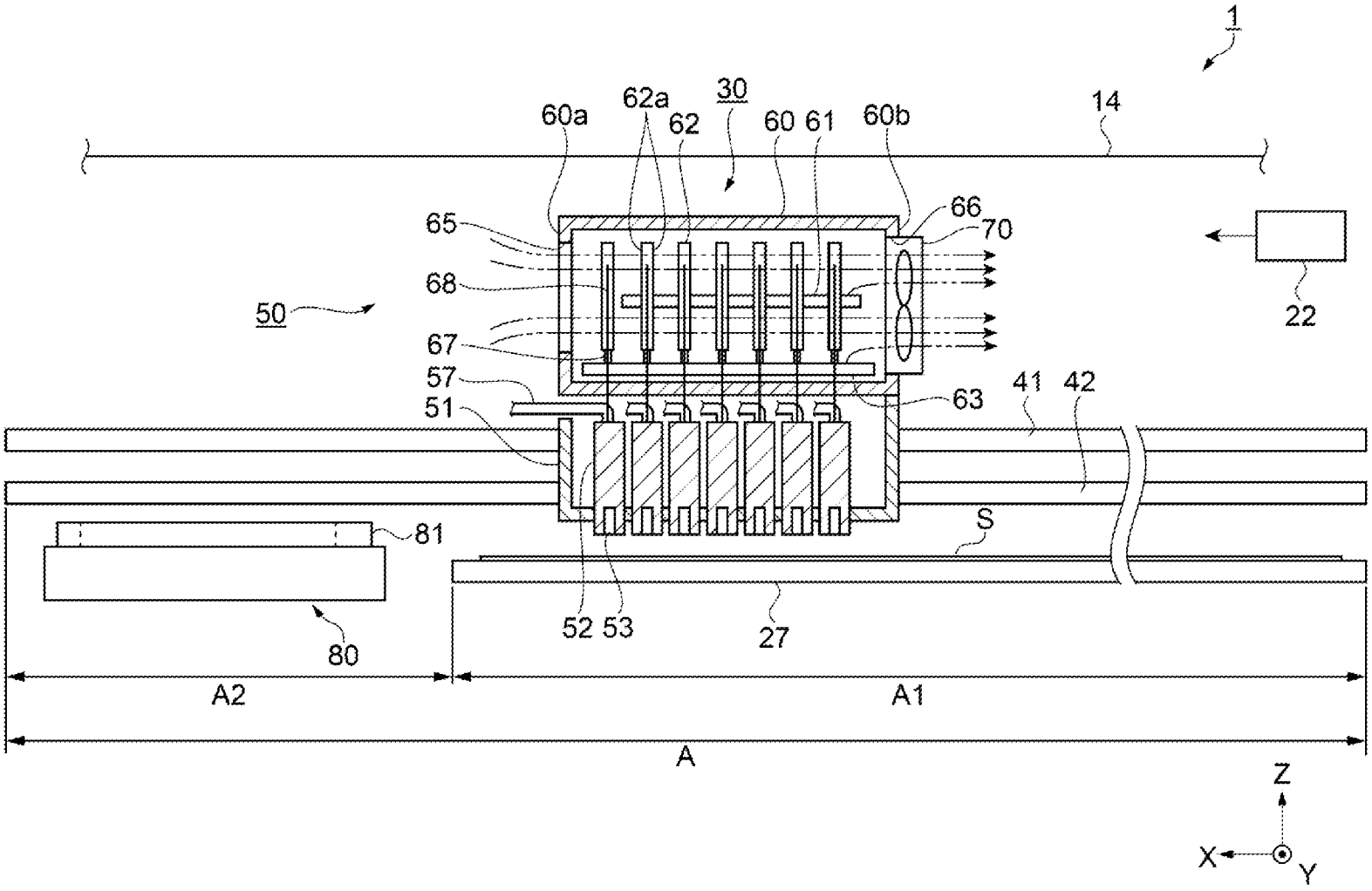
FIG. 4 is a schematic cross-sectional view of the peripheral configuration including the printing unit of the printing apparatus when viewed from an apparatus front side.

FIG. 3 is a schematic cross-sectional view of a peripheral configuration including the printing unit 30 of the printing apparatus 1 when viewed from the apparatus right side. FIG. 4 is a schematic cross-sectional view of the peripheral configuration including the printing unit 30 of the printing apparatus 1 when viewed from the apparatus front side.

The printing unit 30 and the peripheral configuration of the printing unit 30 will be described with reference to FIG. 3 and FIG. 4.

As illustrated in FIG. 3, the transport roller 25 includes a driving roller 251 configured to impart a transport force to the sheet S, a driven roller 252 configured to press the sheet S against the driving roller 251, and a rotation mechanism 26 configured to drive the driving roller 251. The driving roller 251 and the driven roller 252 are rollers using the scanning direction X as an axial direction. The driving roller 251 is disposed vertically below the transport path for the sheet S, and the driven roller 252 is disposed vertically above the transport path for the sheet S.

The rotation mechanism 26 includes, for example, a motor and a reduction gear, or the like. Then, with the sheet S sandwiched between the driving roller 251 and the driven roller 252, the driving roller 251 is rotated to transport the sheet S in the transport direction F.

As described above, the printing unit 30 is equipped with the two carriage shafts 41 and 42 installed to extend in the width direction X, the carriage 50 supported by the carriage shafts 41 and 42, and the discharge heads 52 held at the lower portion of the carriage 50. Note that the two carriage shafts 41 and 42 are supported by a carriage frame 40.

The carriage 50 includes a cartridge case 51 generally shaped like a box. The carriage 50 supports a circuit case 60 above the carriage case 51. Accordingly, reciprocation of the carriage 50 in the scanning direction X also reciprocates the circuit case 60 in the scanning direction X.

The circuit case 60 is shaped like a box, and is internally equipped with three types of circuit boards, a head control board 61, head driving boards 62, and a sub-circuit board 63, which will be described later. Hereinafter, the names of the three types of circuit boards are general terms for configurations of circuits that implement necessary functions and in which various electric elements are mounted.

As illustrated in FIG. 3 and FIG. 4, in the present embodiment, the circuit case 60 is positioned above the carriage frame 40 in the vertical direction, and the discharge heads 52, which will be described below, are positioned below the circuit case 60.

As illustrated in FIG. 4, the circuit case 60 includes an air intake port 65 in a left side surface 60*a* corresponding to a first surface intersecting with the scanning direction X. The circuit case 60 includes an exhaust port 66 in a right side surface 60*b* corresponding to a second surface intersecting with the scanning direction X. At the exhaust port 66, an exhaust fan 70 is installed. Note that the exhaust fan 70 includes, for example, an axial fan. Note that the axial fan has a structure in which air sucked from the direction of a rotation axis is discharged in the direction of the rotation axis.

An operation, by the exhaust fan 70, of cooling the inside of the circuit case 60 will be described below.

A control signal from the control unit 22 is input to the head control board 61. The head control board 61 then controls each of the discharge heads 52 by generating a control waveform for controlling the shape of a drive waveform output by the corresponding head driving board 62, a timing to output the drive waveform, and the like, and outputting the control waveform to each of the head driving boards 62. The exhaust fan 70 according to the present embodiment is also controlled via the head control board 61.

Each of the head driving boards 62 generates a drive waveform corresponding to the control waveform input from the head control board 61, and outputs the drive waveform to the corresponding discharge head 52 (specifically, actuator 531) to cause the nozzles 53 corresponding to the actuator 531 to discharge the ink. For example, the head driving circuit 62 inputs a drive waveform with a large amplitude to the actuator 531 when large ink droplets are to be discharged from the nozzles 53, and inputs a drive waveform with a small amplitude to the actuator 531 when small ink droplets are to be discharged from the nozzles 53.

Note that the head driving boards 62 are installed in association with the types and colors of inks used for printing, and seven head driving boards are installed in the present embodiment. In other words, the head driving boards 62 are installed in correspondence with the number of discharge heads 52 used. Note that the sub-circuit board 63 complements operations of each circuit board by, for example, being equipped with a temperature sensor (not illustrated).

As illustrated in FIG. 3 and FIG. 4, in the seven head driving boards 62 according to the present embodiment, component surfaces 62*a* on which the various elements constituting each head driving board 62 are mounted intersect with the scanning direction X, and the component surfaces 62*a* of the respective head driving circuits 62 are installed away from one another and side by side in the scanning direction X. In other words, the head driving boards 62 are installed in alignment with arrangement of the discharge heads 52. With this installation manner, the plurality of head driving boards 62 can be installed compactly, and a space-efficient arrangement can be achieved. Note that the component surfaces 62*a* of the plurality of head driving boards 62 and the exhaust fan 70 are installed staggered from each other when viewed from the scanning direction X, as illustrated in FIG. 3.

As illustrated in FIG. 3 and FIG. 4, the single head control board 61 is configured and installed horizontally on a rear side of the head driving boards 62 at a substantially intermediate position of the circuit case 60 in the height direction Z. The head control board 61 has a board cross section overlapping with the exhaust fan 70 when viewed from the scanning direction X. As illustrated in FIG. 3 and FIG. 4, the single sub-circuit board 63 is configured and installed horizontally near an inner bottom surface of the circuit case 60. The sub-circuit board 63 has a board cross section partially overlapping with the exhaust fan 70 when viewed from the scanning direction X.

The head control board 61 is electrically coupled to the control unit 22 via a coupling cable (not illustrated). The coupling cable is configured to couple the head control circuit 61, disposed in the carriage 50 reciprocating in the scanning direction X, and the control unit 22, fixedly disposed inside the housing portion 14. Thus, as the coupling cable, a Flexible Flat Cable (FFC) is used that is deformed depending on movement of the carriage 50.

The head driving boards 62 are electrically coupled to the sub-circuit board 63 via respective connectors 67. The plurality of head driving boards 62 are electrically coupled to the corresponding discharge heads 52 via respective coupling cables 68. Note that the coupling cables 68, in the form of folded-back FFCs, couple the head driving boards 62 to the discharge heads 52 located below and in front of the head driving boards 62.

As illustrated in FIGS. 3 and 4, the carriage case 51 internally includes the discharge heads 52 configured to discharge the ink. The discharge heads 52 are installed in association with the types and colors of the inks used for printing, and seven discharge heads 52 are installed in the present embodiment. Each of the discharge heads 52 is configured as what is called an ink jet head, including the nozzles 53 with the respective actuators 531 such as piezoelectric elements driven to discharge the ink. Note that a plurality of nozzles 53 are installed at high density in each of the discharge heads 52.

As illustrated in FIG. 4, the carriage 50 internally includes first supply tubes 57 corresponding to the respective discharge heads 52 and configured to supply the respective inks. Note that the first supply tubes 57 are coupled to the liquid reservoirs 24 illustrated in FIG. 1 with second supply tubes (not illustrated). The second supply tubes are flexible enough to be deformed depending on the carriage 50 reciprocating in the scanning direction X. The tubes allow the inks in the liquid reservoirs 24 to be supplied to the discharge heads 52. Note that, as illustrated in FIG. 4, the first supply tubes 57 are installed by being drawn from the air intake port 65 side into the carriage 50 (in particular, the carriage case 51).

As illustrated in FIG. 3, a movement mechanism 55 is a mechanism including a motor and a reduction gear and converting rotation of the motor into movement in the scanning direction X of the carriage 50. Accordingly, in the present embodiment, driving the movement mechanism 55 moves the carriage 50 in the scanning direction X. Note that the carriage 50 is guided and moved by two carriage shafts 41 and 42 serving as a prism-shaped shaft member supported by the carriage frame 40.

As illustrated in FIG. 3, the carriage 50 and the carriage shafts 41 and 42 according to the present embodiment are engaged with one another via bearings 58 fixed to the carriage 50 side, and the carriage 50 is movable relative to the carriage shaft 41 and 42. On a rear side of and at lateral end portions of the carriage 50, two bearings 58 are installed corresponding to the carriage shaft 41 and two other bearings 58 are installed corresponding to the other carriage shaft 42.

Note that the bearings 58 are configured as what is called recirculating ball linear bearings. The carriage 50 according to the present embodiment has a weight of several tens of kgs. However, the use of the two carriage shafts 41 and 42 allows prevention of rotation of the carriage 50 around an axis and suppression of the adverse effect of vibration or the like, and enables the carriage 50 to reciprocate smoothly via the bearings 58 relative to the carriage shafts 41 and 42.

Here, when a print instruction is input via the operation panel 23, the control unit 22 causes the sheet S to be printed by integrally controlling driving of each of the components. Specifically, the control unit 22 causes the sheet S to be printed by alternately performing a transport operation in which the rotation mechanism 26 is driven to transport the sheet S by a unit transport amount in the transport direction F and a discharge operation in which the inks are discharged from the discharge heads 52 while the movement mechanism 55 is being driven to move the carriage 50 in the scanning direction X.

Note that when printing is performed, the head control board 61, the head driving boards 62, and the sub-circuit board 63 generate heat. Thus, when printing is performed, the control unit 22 drives the exhaust fan 70 to suck the air from the outside into the circuit case 60 via the air intake port 65, and discharges, to the outside of the circuit case 60, the air sucked through the exhaust fan 70.

Specifically, when the exhaust fan 70 is driven, the air outside of the circuit case 60 is sucked into the circuit case 60 through the air intake port 65. In this case, in particular, the air located to the left of the air intake port 65 in the scanning direction X is sucked. The air sucked into the circuit case 60 is exhausted to the outside of the circuit case 60 by the exhaust fan 70. In this case, the air is exhausted to the right of the exhaust fan 70 in the scanning direction X.

In this operation, the air sucked into the circuit case 60 is heated by drawing heat from inside the circuit case 60, and the heated air is exhausted to the outside of the circuit case 60 via the exhaust fan 70. Note that the heat inside the circuit case 60 is generated by the head control board 61, the head driving boards 62, and the sub-circuit board 63, and the heat is radiated to the outside to cool the head control board 61, the head driving boards 62, and the sub-circuit board 63. Note that, in the drawings illustrated in FIG. 3 and FIG. 4, the flow direction of the air is indicated by an arrow of a double dot chain line.

Additionally, cooling the head control board 61, the head driving boards 62, and the sub-circuit board 63 enables a reduction in the temperature of the various elements mounted on the head control board 61, the head driving boards 62, and the sub-circuit board 63 to an allowable temperature or lower. This allows prevention of a failure in the printing apparatus 1 caused by the temperature of the head control board 61, the head driving boards 62, and the sub-circuit board 63.

The component surfaces 62*a* of the seven head driving boards 62 and the exhaust fan 70 are installed staggered from each other when viewed from the scanning direction X. This allows each head driving board 62 itself to be suppressed from blocking the flow, to the exhaust fan 70, of air sucked through the air intake port 65. Thus, the sucked air can efficiently draw heat generated by the seven head driving boards 62 installed side by side.

Note that in the present embodiment, the component surfaces 62*a* of the head driving boards 62 are installed completely shifted from the exhaust fan 70 when viewed from the scanning direction X, as illustrated in FIG. 3. However, no such limitation is intended, and it is sufficient that the head driving boards 62 are installed so as not to overlap with the entire exhaust fan 70, in other words, the head driving boards 62 are installed at least partially shifted with the exhaust fan 70 instead of covering the entire exhaust fan 70.

The air intake port 65 and the exhaust port 66 of the circuit case 60 are installed at positions allowing the air flowing from intake to exhaust to flow substantially along the scanning direction X. In the present embodiment, the air intake port 65 and the exhaust port 66 are installed such that the air flows from the left side to the right side along the scanning direction X when viewed from the apparatus front side. This configuration suppresses the direct flow of exhausted heated air toward the discharge heads 52 located below the circuit case 60.

Figure 5:
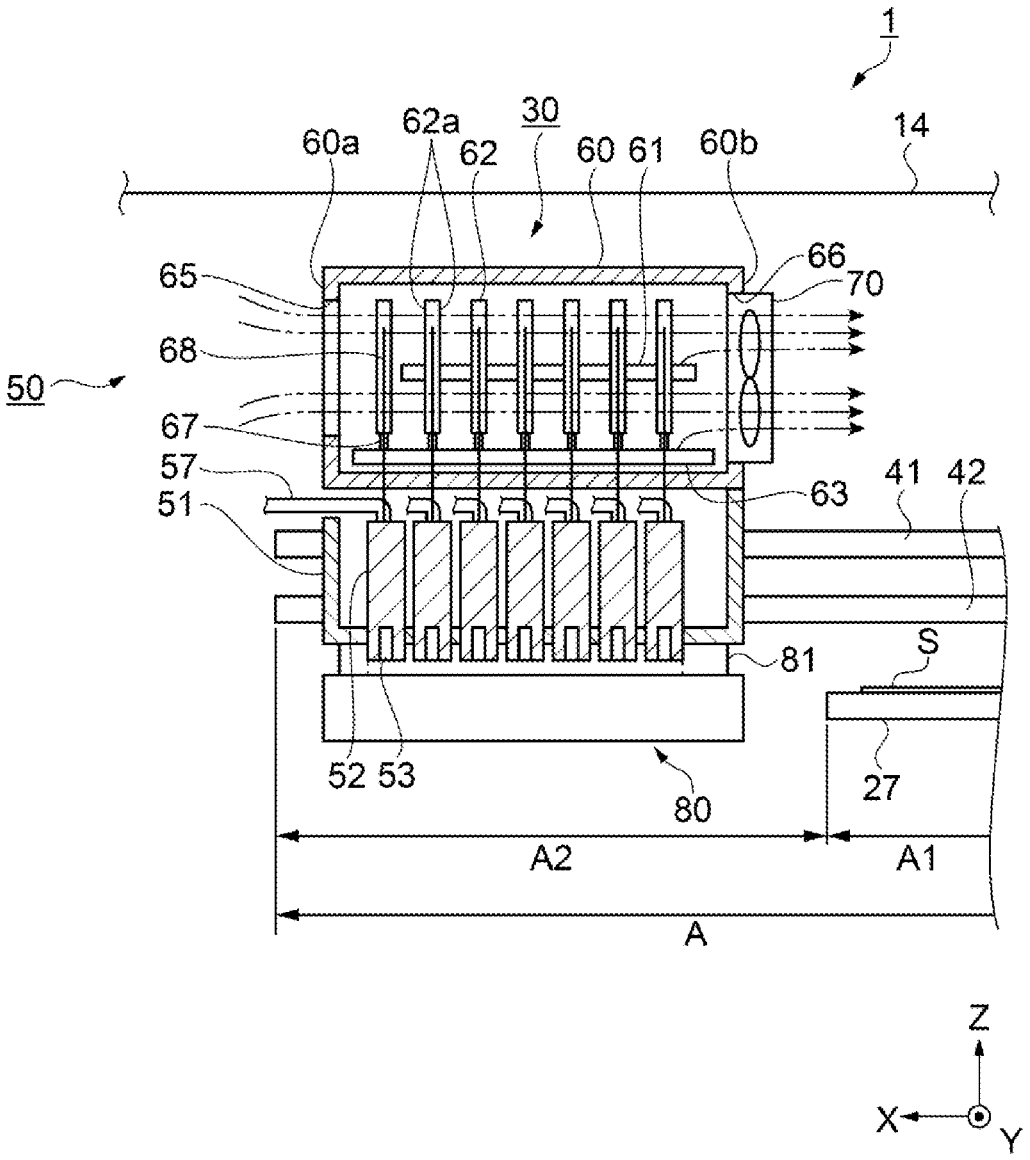
FIG. 5 is a schematic cross-sectional view of a carriage of the printing apparatus positioned in a maintenance region when viewed from the apparatus front side.

As illustrated in FIG. 4 and FIG. 5, the carriage 50 reciprocates along the carriage shafts 41 and 42 in the scanning direction X, which is orthogonal to the transport direction F of the sheet S. In the scanning direction X, a region where the carriage 50 is movable is referred to as a movement region A. In that case, the carriage 50 reciprocates within the movement region A. According to the present embodiment, in the printing apparatus 1, a region that is included in the movement region A where the carriage 50 is movable and in which discharge heads 52 discharge the inks toward the sheet S supported by the platen 27 is defined as an ink discharge region A1. A region that is included in the movement region A and in which maintenance work for the discharge heads 52 is performed is defined as a maintenance region A2.

The ink discharge region A1 is a region in which the carriage 50 is positioned when the discharge heads 52 face the platen 27. The maintenance region A2 is a region in which the carriage 50 is positioned when the discharge heads 52 face the maintenance unit 80. Note that, in FIG. 4 and FIG. 5, each of the regions A, A1, and A2 is illustrated as a one-dimensional length, but actually refers to a three-dimensional space through which the carriage 50 passes during movement.

As illustrated in FIG. 4 and FIG. 5, a maintenance unit 80 is provided adjacent to the platen 27 in the scanning direction X. The maintenance unit 80 is installed on the left side of the platen 27 when viewed from the apparatus front side. In the present embodiment, the maintenance unit 80 includes a cap 81. The maintenance unit 80 performs capping by bringing the cap 81 into contact with the discharge heads 52 to cause an opened space of the nozzles 53 to be a closed space. The capping is performed to suppress drying of the nozzles 53 in the discharge heads 52 after printing is ended, and is an example of maintenance work according to the present embodiment.

Note that when printing is ended and the carriage 50 is positioned in the maintenance region A2 where the maintenance work for the discharge heads 52 is performed, the exhaust fan 70 is rotated according to the present embodiment. Specifically, in the present embodiment, when the discharge heads 52 of the carriage 50 are capped by the cap 81 of the maintenance unit 80, the exhaust fan 70 rotates. During the capping, in the present embodiment, the exhaust fan 70 is driven to cool the head control board 61, the head driving boards 62, and the sub-circuit board 63.

With this operation, for example, when the necessity arises to perform the maintenance work for the discharge heads 52 and to cool the head control board 61, the head driving boards 62, and the sub-circuit board 63, this configuration enables a reduction in downtime when the discharge heads 52 are prevented from discharging the inks onto the sheet S, compared to a configuration in which the maintenance work for the discharge heads 52 and the cooling of the circuit boards are independently performed.

In this case, since the maintenance unit 80 is positioned on the apparatus left side of the platen 27, the exhaust fan 70 exhausts the air toward the platen 27 positioned on the apparatus right side. Accordingly, during the maintenance work, the exhaust fan 70 exhausts the air in the circuit case 60 toward the platen 27 side. This configuration enables suppression of ingression of mist into the circuit case 60, allowing the elements to be suppressed from being damaged by the mist, compared to a configuration in which the exhaust fan 70 exhausts the air toward a side opposite to the platen 27 side.

As described above, the printing apparatus 1 according to present embodiment can provide the following advantages.

According to the printing apparatus 1 of the present embodiment, the circuit case 60 includes the air intake port 65 in the left side surface 60*a* intersecting with the scanning direction X, and the exhaust port 66 in the right side surface 60*b* intersecting with the scanning direction X. Rotation of the exhaust fan 70 installed at the exhaust port 66 causes the air sucked into the circuit case 60 through the air intake port 65 to draw heat generated by the head control board 61, the head driving boards 62, and the sub-circuit board 63 installed inside the circuit case 60. The air is thus heated and then exhausted to the outside of the circuit case 60 via the exhaust fan 70. Accordingly, the temperature of the elements mounted on the head control board 61, the head driving boards 62, and the sub-circuit board 63 can be reduced to the allowable temperature or lower. Accordingly, the head control board 61, the head driving boards 62, and the sub-circuit board 63 can be maintained at an appropriate temperature. This allows prevention of a failure in the printing apparatus 1 caused by the temperatures of the head control board 61, the head driving boards 62, and the sub-circuit board 63.

According to the printing apparatus 1 of the present embodiment, the circuit case 60 is positioned above, in the vertical direction, the carriage frame 40 configured to support the carriage 50, and the discharge heads 52 are positioned below the circuit case 60. Accordingly, the heated air exhausted from the exhaust fan 70 is exhausted along the scanning direction X and thus not exhausted toward the discharge heads 52 positioned below the circuit case 60. This prevents deterioration of the quality of the inks, such as drying of the inks, allowing discharge performance of the discharge heads 52 to be maintained.

Even when the exhaust fan 70 installed in the circuit case 60 is driven, the vibration is less likely to be transmitted to the discharge heads 52 due to the use of the two carriage shafts 41 and 42. The exhaust fan 70 is supported by the circuit case 60, and the discharge heads 52 are positioned below the circuit case 60 and supported by the carriage 50 (carriage case 51). Thus, vibration caused by driving of the exhaust fan 70 is less likely to be transmitted to the discharge heads 52. Accordingly, the printing quality of the discharge heads 52 can be maintained.

According to the printing apparatus 1 of the present embodiment, the exhaust fan 70 rotates even when the carriage 50 is positioned in the maintenance region A2. Note that, when the maintenance work for the discharge heads 52 is performed, the inks may be discharged from the discharge heads 52 depending on the contents of the maintenance work. In such a case, the actuators 531 are driven by the head driving circuit 62, the head driving circuit 62 may generate heat even when the carriage 50 is positioned in the maintenance region A2. Even in such a case, in the present embodiment, the exhaust fan 70 is driven, allowing the head driving boards 62 to be suppressed from generating heat.

When the maintenance work for the discharge heads 52 is performed, for example, the necessity may arise to perform the maintenance work for the discharge heads 52 and to cool the head control board 61, the head driving boards 62, and the sub-circuit board 63. In this case, when the carriage 50 is positioned in the maintenance region A2, the rotation of the exhaust fan 70 enables a reduction in downtime when the discharge heads 52 are prevented from discharging the inks onto the sheet S, compared to a configuration in which the maintenance work for the discharge heads 52 and the cooling of the head control board 61, the head driving boards 62, and the sub-circuit board 63 are independently performed.

According to the printing apparatus 1 of the present embodiment, the exhaust fan 70 exhausts the air toward the platen 27 side during the maintenance work. Here, when the discharge heads 52 discharge the inks, the discharged inks may scatter and float as mist and adhere to surrounding structures. However, since, during the maintenance work, the exhaust fan 70 exhausts the air inside the circuit case 60 toward the platen 27 side, this configuration enables suppression of ingression of mist into the circuit case 60, allowing the elements to be suppressed from being damaged by the mist, compared to a configuration in which the exhaust fan 70 exhausts the air toward the side opposite to the platen 27 side.

According to the printing apparatus 1 of the present embodiment, the first supply tubes 57 configured to supply the inks to the discharge heads 52 are installed by being drawn into the carriage 50 from the air intake port 65 side. Thus, the first supply tubes 57 can be positioned away from the exhaust fan 70, which exhausts heated air, allowing the first supply tubes 57 to be prevented from being affected by the heat inside the circuit case 60. Accordingly, the quality of the ink flowing through the first supply tubes 57 is prevented from being degraded, allowing the discharge performance of the discharge heads 52 to be maintained.

According to the printing apparatus 1 of the present embodiment, in the circuit case 60, the component surfaces 62*a* of the respective head driving boards 62 intersect with the scanning direction X, and are installed away from one another and side by side in the scanning direction X. Thus, the head driving boards 62 can be installed in alignment with the arrangement of the discharge heads 52, leading to space-efficient arrangement.

The component surfaces 62*a* of the head driving boards 62 and the exhaust fan 70 are installed staggered from each other when viewed from the scanning direction X. This allows each head driving board 62 itself to be inhibited from blocking the flow, to the exhaust fan 70, of air sucked through the air intake port 65. Accordingly, the sucked air can efficiently draw heat generated by the seven head driving boards 62 installed side by side, enabling efficient cooling.

Such arrangement of the head driving boards 62 enables an easy increase or reduction in the number of head driving boards 62 in association with an increase or reduction in the number of discharge heads 52. This allows extendibility of the discharging heads 52 to be improved.

Note that, the present disclosure is not limited to the exemplary embodiments described above, and various modifications and improvements can be added to the above-described embodiments. Such modifications will be described below.

Modification 1

In the printing apparatus 1, the exhaust fan 70 may be installed at the air intake port 65 and used as an air intake fan. In this configuration, the air intake fan (exhaust fan 70) installed at the air intake port 65 is used to suck the external air into the circuit case 60, and the sucked air draws heat generated by the head control board 61, the head driving boards 62, and the sub-circuit board 63. The heated air is exhausted to the outside of the circuit case 60 via the exhaust port 66. Such an operation can also exert effects similar to those in the above-mentioned embodiment.

Modification 2

In the printing apparatus 1, the carriage 50 includes the carriage case 51, and the circuit case 60 is supported above the carriage case 51. However, no such limitation is intended, and the carriage case 51 and the circuit case 60 may be integrally formed.

Modification 3

In the printing apparatus 1, the maintenance unit 80 may be configured to perform maintenance work other than the capping. For example, the maintenance unit 80 may include a wiper and perform wiping on a nozzle formation surface of each discharge head 52 on which the nozzles 53 are formed.

Modification 4

In the printing apparatus 1, the maintenance unit 80 may include a decompression unit for reducing pressure inside the cap 81 and perform cleaning in which the pressure inside the cap 81 is reduced after the capping to forcibly discharge the inks from the nozzles 53 in the discharge heads 52.

Modification 5

In the printing apparatus 1, the maintenance unit 80 may include a flushing box with an opening at an upper portion of the flushing box in the vertical direction, and receive, in the flushing box, the inks discharged from the discharge heads 52 regardless of printing.

Modification 6

In the printing apparatus 1, when viewed from the scanning direction X, the head control board 61 is installed horizontally on the rear side of the head driving boards 62 at a substantially intermediate position of the circuit case 60 in the height direction Z, and has a board cross section overlapping with the exhaust fan 70. However, it is sufficient that the positional relationship between the exhaust fan 70 and the head control board 61 when viewed from the scanning direction X is such that the head control board 61 is installed so as not to overlap with the entire exhaust fan 70, in other words, the head control board 61 is installed at least partially shifted with the exhaust fan 70 instead of covering the entire exhaust fan 70. This also applies to the sub-circuit board 63.

Modification 7

In the printing apparatus 1, examples of the medium may include fiber, leather, plastic, wood, and ceramics, besides the sheet. The medium may be, instead of a medium unrolled from the roll body, a single-sheet-like medium or a simply elongate medium.

Modification 8

In the printing apparatus 1, droplets discharged or ejected by the discharge heads 52 are not limited to ink, but may be, for example, a liquid material or the like obtained by dispersing or mixing particles of functional materials in a liquid. For example, a configuration may be adopted that performs printing by discharging a liquid material including, in a dispersed or dissolved form, a material such as an electrode material or a color material (pixel material) used in the manufacture of liquid crystal displays, electroluminescent (EL) displays, surface emitting displays, and the like.

Contents derived from the exemplary embodiments describe above will be described below.

A printing apparatus includes a discharge head configured to discharge a liquid toward a medium, a head control board configured to control the discharge head, a circuit case having a box-like shape configured to house the head control board, and a carriage configured to reciprocate in a scanning direction while supporting the discharge head and the circuit case. The circuit case includes an air intake port in one surface thereof, with the one surface intersecting with the scanning direction, and includes an exhaust port in another surface thereof, with the other surface intersecting with the scanning direction. At the exhaust port, an exhaust fan configured to exhaust, to outside of the circuit case, heat that is inside the circuit case is installed, the heat being generated by the head control board.

According to this configuration, the circuit case includes the air intake port in the first surface intersecting with the scanning direction and the exhaust port in the second surface intersecting with the scanning direction, and the exhaust fan installed at the exhaust port is driven and rotated. This causes air sucked into the circuit case through the air intake port to draw heat generated by the head control board installed inside the circuit case. The heated air is exhausted to the outside of the circuit case via the exhaust fan. This allows the temperature of the elements mounted on the head control board to be reduced to the allowable temperature or lower. Accordingly, the head control board can be maintained at the appropriate temperature, allowing prevention of a failure in the printing apparatus caused by the temperature of the head control board.

Preferably, the printing apparatus described above includes a carriage shaft configured to move the carriage and a frame configured to support the carriage shaft. The circuit case is preferably positioned at an upper side of the frame in a vertical direction, and the discharge head is positioned at a lower side of the circuit case.

According to this configuration, the circuit case is positioned at the upper side of the frame in the vertical direction, and the discharge head is positioned at the lower side of the circuit case. Accordingly, the heated air from the exhaust fan is exhausted along the scanning direction and thus not exhausted toward the discharge head positioned below the circuit case. This prevents deterioration of the quality of the liquid, such as drying of the liquid, allowing discharge performance of the discharge head to be maintained.

The exhaust fan is supported by the circuit case, and the discharge head is positioned at the lower side of the circuit case and supported by the carriage. Thus, vibration caused by driving of the exhaust fan is less likely to be transmitted to the discharge head. Accordingly, the printing quality of the discharge head can be maintained.

Preferably, the printing apparatus described above includes a maintenance region where maintenance of the discharge head is performed, and rotates when the carriage is positioned in the maintenance region.

According to this configuration, the exhaust fan rotates even when the maintenance of the discharge head is performed. Thus, for example, when the necessity arises to perform the maintenance work for the discharge head and to cool the head control board, the configuration enables a reduction in downtime when the discharge head is prevented from discharging the liquid onto the medium, compared to a configuration in which the maintenance of the discharge head and the cooling of the head control board are independently performed.

Preferably, the printing apparatus described above includes a platen configured to guide transport of the medium, and the exhaust fan exhausts air toward the platen side.

According to this configuration, the exhaust fan exhausts the air toward the platen side during the maintenance. Here, when the liquid is discharged by the discharge head, the discharged liquid may scatter and float as mist and adhere to surrounding structures. However, since, during the maintenance work, the exhaust fan exhausts the air in the circuit case toward the platen side, this configuration enables suppression of ingression of mist into the circuit case, allowing elements to be suppressed from being damaged by the mist, compared to a configuration in which the exhaust fan exhausts the air toward a side opposite to the platen side.

Preferably, the printing apparatus described above includes a supply tube configured to supply the liquid to the discharge head, and the supply tube is installed by being drawn into the carriage from the air intake port side.

According to this configuration, the supply tube that supplies the liquid to the discharge head is drawn into the carriage from the air intake port side. Thus, the supply tube can be positioned away from the exhaust fan from which the heated air is exhausted, allowing suppression of the adverse effect, on the supply tube, of the heat in the circuit case. Accordingly, the quality of the liquid flowing through the supply tube is prevented from being degraded, allowing the discharge performance of the discharge head to be maintained.

Preferably, in the printing apparatus described above, the circuit case includes therein a plurality of head driving boards, provided separately from the head control board, the plurality of head driving boards have component surfaces intersecting with the scanning direction, with the component surfaces of the respective head driving boards being installed away from one another and side by side in the scanning direction, and the component surfaces and the exhaust fan are installed staggered from each other when viewed from the scanning direction.

According to this configuration, in the circuit case, the component surfaces of the respective head driving boards intersect with the scanning direction, and are installed away from one another and side by side in the scanning direction. Thus, the head driving boards can be installed in alignment with arrangement of discharge heads, leading to a space-efficient arrangement.

The component surfaces of the head driving boards and the exhaust fan are installed staggered from each other when viewed from the scanning direction. This allows each head driving board itself to be inhibited from blocking the flow, to the exhaust fan, of the air sucked through the air intake port. Accordingly, the sucked air can efficiently draw heat generated by the plurality of head driving boards installed side by side, enabling efficient cooling.

Such arrangement of the head driving boards enables an easy increase or reduction in the number of head driving boards in association with an increase or reduction in the number of discharge heads. This allows extendibility of the discharging head to be improved.

What is claimed is:

1. A printing apparatus comprising:

a printing apparatus main body;

a discharge head configured to discharge a liquid toward a medium;

a head control board configured to control the discharge head;

a circuit case having a box-like shape configured to house the head control board, the circuit case being different from the printing apparatus main body and being enclosed by the printing apparatus main body; and a carriage configured to reciprocate in a scanning direction while supporting the discharge head and the circuit case, wherein the circuit case includes an air intake port in one surface thereof, with the one surface and an opening of the air intake port intersecting with the scanning direction, and includes an exhaust port in another surface thereof, with the other surface and an opening of the exhaust port intersecting with the scanning direction, and at the exhaust port, an exhaust fan configured to exhaust, to outside of the circuit case, heat that is inside the circuit case is installed, the heat being generated by the head control board.

2. The printing apparatus according to claim 1, comprising:

a carriage shaft configured to move the carriage; and a frame configured to support the carriage shaft, wherein the circuit case is positioned at an upper side of the frame in a vertical direction, and the discharge head is positioned at a lower side of the circuit case.

3. The printing apparatus according to claim 1, comprising a maintenance region where maintenance of the discharge head is performed, wherein the exhaust fan rotates when the carriage is positioned in the maintenance region.

4. The printing apparatus according to claim 3, comprising a platen configured to guide transport of the medium, wherein the exhaust fan exhausts air toward the platen side.

5. The printing apparatus according to claim 1, comprising a supply tube configured to supply the liquid to the discharge head, wherein the supply tube is installed by being drawn into the carriage from the air intake port side.

6. The printing apparatus according to claim 1, wherein the circuit case includes therein a plurality of head driving boards, provided separately from the head control board, and the plurality of head driving boards have component surfaces intersecting with the scanning direction, with the component surfaces of the head driving boards being installed away from one another and side by side in the scanning direction, and the component surfaces and the exhaust fan are installed staggered from each other when viewed from the scanning direction.

* * * * *